US005221143A

United States Patent [19]

Peppiatt

[11] Patent Number: 5,221,143

[45] Date of Patent: Jun. 22, 1993

[54] FLEXIBLE DUPLEX BAG HAVING A RESEALABLE CLOSURE AND A METHOD OF MAKING SAME

[75] Inventor: Harry R. Peppiatt, Doylestown, Pa.

[73] Assignee: Paramount Packaging Corporation, Chalfont, Pa.

[21] Appl. No.: 711,885

[22] Filed: Jun. 7, 1991

Related U.S. Application Data

[63] Continuation-in-part of Ser. No. 536,057, Jun. 8, 1990, Pat. No. 5,112,138.

[51] Int. Cl.[5] ..... B65D 30/08; B65D 33/10

[52] U.S. Cl. ..... 383/29; 383/63; 383/66; 383/81

[58] Field of Search ..... 383/21, 29, 66, 63, 383/81

[56] References Cited

U.S. PATENT DOCUMENTS

| | | | |
|---|---|---|---|
| 3,181,583 | 5/1965 | Lingenfelter | 383/63 |
| 3,204,856 | 9/1965 | Wilson | 383/66 |
| 3,208,492 | 9/1965 | Braithwaite | 383/21 |
| 3,276,669 | 10/1966 | Vilutis | 383/66 |
| 4,573,203 | 2/1986 | Peppiatt | 383/29 |
| 4,691,373 | 9/1987 | Ausnit | 383/63 |
| 4,713,839 | 12/1987 | Peppiatt | 383/29 |
| 4,877,336 | 10/1989 | Peppiatt | 383/63 |
| 5,033,868 | 7/1991 | Peppiatt | 383/29 |
| 5,080,497 | 1/1992 | Peppiatt | 383/21 |
| 5,112,138 | 5/1992 | Peppiatt | 383/21 |

*Primary Examiner*—Stephen P. Garbe

*Attorney, Agent, or Firm*—Fitzpatrick, Cella, Harper & Scinto

[57] ABSTRACT

A flexible duplex bag having a resealable closure and a method of making same includes an outer bag having (a) front and rear panels connected together at side edges thereof, (b) a gusset connecting together top portions of said front and rear panels. An inner bag substantially co-extensive with the outer bag is provided and has (a) front and rear panels connected together at side edges thereof, and (b) a gusset connecting together top portions of the inner bag front and rear panels. A resealable closure is provided connected to the outer bag gusset astride a location where the outer bag gusset joins the outer bag front panel. A handle is connected to the outer bag and bridges the outer bag gusset. The resealable closure preferably includes a first matable section bonded to the outer bag gusset, and a second matable section bonded to a top portion of the outer bag front panel. In a first embodiment, the handle is coupled to the outer bag rear panel and to the second matable section of the resealable closure. In a second preferred embodiment, the handle is coupled to the outer bag rear panel and is either coupled to or integral with the first matable section bonded to the outer bag gusset.

35 Claims, 7 Drawing Sheets

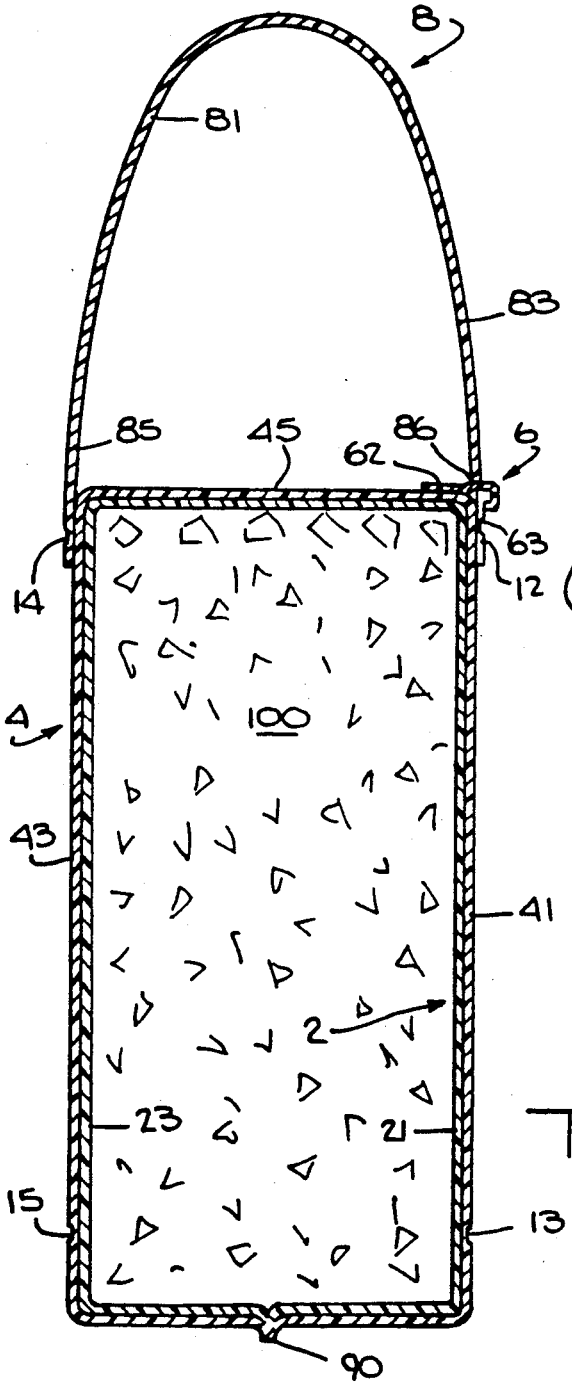
Fig.14.
Fig.13.
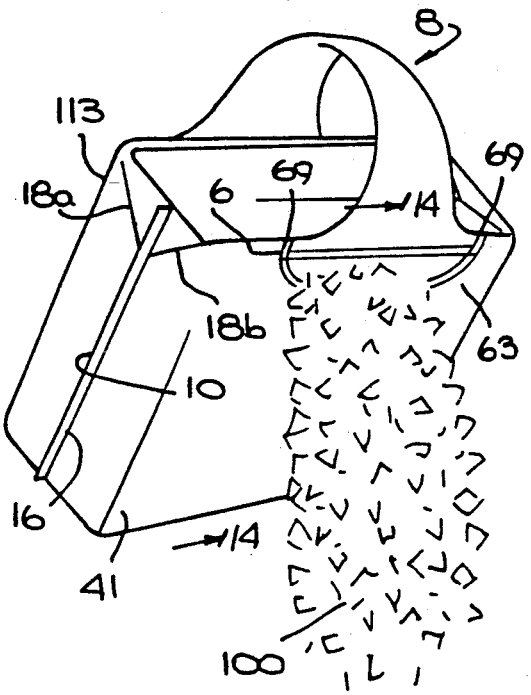

FLEXIBLE DUPLEX BAG HAVING A RESEALABLE CLOSURE AND A METHOD OF MAKING SAME

RELATED APPLICATIONS

This is a continuation-in-part of co-pending application Ser. No. 07/536,057, filed Jun. 8, 1990, now U.S. Pat. No. 5,112,138 by Harry R. Peppiatt.

This unique thick ultrasonic seal provides further bag stability and ensures bag strength at the critical points.

FIELD OF THE INVENTION

The present invention is directed to a flexible duplex bag having a resealable closure for keeping products stored therein fresh. The invention is also directed to such a flexible bag which can be fabricated by mass production techniques.

BACKGROUND OF THE INVENTION

Many products are shipped and sold in containers which are not well suited to retain product freshness throughout the period during which the contents of the container are used or consumed. Pet food is one example of such a product. It is typically sold, for reasons of economy and convenience, in bulk quantities.

The containers used, however, are plastic-lined paper bags, wax-lined paper bags, or cardboard boxes, which containers do little to prevent the long term absorption or release of moisture or emission of odor during the period of time in which the products are being consumed. Once these containers are opened, product freshness deteriorates rapidly. At present, purchasers of such bulk-quantity products, in order to preserve freshness, are required to re-store the product in a plurality of smaller resealable containers immediately after the bulk-quantity container is opened. The bothersome procedure of pouring pet food from a large paper bag into a plurality of small resealable plastic containers is well-known to many pet owners.

Another problem with known bulk-quantity containers is their lack of structure for controlling the pouring of the product from the bag. Again, pet owners are all too familiar with the experience of pet food rolling around the kitchen floor when pet food is poured from a paper container into a plurality of smaller, resealable plastic containers. Therefore, it is desirable to provide a flexible bag for bulk quantity products in which the bag itself is resealable and the pouring of the product can be easily controlled.

A further problem with known bulk-quantity containers is their non-homogenous structure. For example, known pet food containers are generally dual substrate systems combining paper, wax paper and/or plastic. Disposal of such dual-substrate containers is quite difficult and injurious to the environment. Like-material containers would allow recycling of the material with the known environmental and economic advantageous thereof. Any bag for this use must, however, be relatively easy and economical to manufacture.

U.S. Pat. No. 4,573,203, issued to the present inventor, discloses a plastic bag having laminated plastic front and rear panels with a loop handle extending therebetween. A line of perforations extends across the top gusset of the bag to provide access of the interior thereof. While this bag is quite useful, it is not resealable and thus inapplicable to products which must retain their freshness.

U.S. Pat. No. 4,713,839, also issued to the present inventor, discloses in FIG. 1, a resealable flexible plastic bag with a loop handle in which a tongue-and-groove resealable structure is formed on the top gusset of the bag. However, as shown in FIG. 1 of that patent, the resealable closure is coupled to the bag ends in such a fashion that the resealable closure lies flat against the top gusset when the bag is filled with product. Also, the resealable closure is formed in the very middle of the top gusset with a line of perforations in the outer gusset beneath the resealable closure. This configuration of resealable closure may make pouring product from the bag inconvenient since the resealable closure tends to be difficult to handle once a given amount of product is emptied.

U.S. Pat. No. 4,877,336, also issued to the present inventor, discloses a duplex bag having a loop handle and a resealable closure in the top gusset, as shown in FIG. 13 thereof. However, this bag offers only a single sheet of plastic between the product and the resealable closure, thus proving somewhat disadvantageous in terms of ensuring product freshness.

The problems solved by the present invention relate to providing a flexible, single-material duplex bag for storing a pourable product while retaining its freshness.

SUMMARY OF THE INVENTION

According to the present invention, a flexible bag includes an outer bag having (a) front and rear panels connected together at side edges thereof, and (b) a gusset connecting together top portions of the front and rear panels. Also provided is an inner bag substantially coextensive with the outer bag and having (a) front and rear panels connected together at side edges thereof, and (b) a gusset connecting together top portions of the inner bag front and rear panels. A resealable closure is connected to the outer bag gusset astride a location where the outer bag gusset joins the outer bag front panel. A handle is connected to the outer bag and bridges the outer bag gusset. Preferably the outer bag gusset has a defined frangible portion (such as a line of perforations) beneath the resealable closure. Also preferably, the inner bag gusset adjacent the defined frangible portion is relatively less frangible than said defined frangible portion.

Also according to the present invention, a flexible plastic bag includes an inner bag having first and second plastic panels bonded together at side edges thereof, and an outer bag including third and fourth plastic panels bonded together at side edges thereof. Inner and outer plastic gussets are provided respectively integral with top portions of the inner and outer bags. Each respective gusset and bag has a M-shaped fold therein. A plastic resealable closure is provided having (a) a first matable section disposed on an outer surface of the outer bag third plastic panel at a top portion of the M-shaped fold, and (b) a second matable section disposed on an outer surface of the outer bag gusset on an inwardly folded surface of the M-shaped fold adjacent the first matable section. A plastic handle is bonded to outside surfaces of the outer bag and extends across the M-shaped folds. Preferably, a defined frangible portion is disposed between the first and second matable sections substantially along a cusp of the outer bag M-shaped fold. Preferably, the inner bag gusset adjacent the defined frangible portion is substantially less frangible than the defined frangible portion.

According to another aspect of the present invention, a flexible plastic bag includes an inner bag having first and second plastic panels bonded together at side edges thereof, and an outer bag including third and fourth plastic panels bonded together at side edges thereof. Inner and outer plastic gussets are provided respectively integral with top portions of the inner and outer bags. Each respective gusset and bag has a M-shaped fold therein. A plastic resealable closure is provided having (a) a first matable section disposed on an outer surface of the outer bag third plastic panel at a top portion of the M-shaped fold, and (b) a second matable section disposed on an outer surface of the outer bag gusset on an inwardly folded surface of the M-shaped fold adjacent the first matable section. A plastic handle is bonded to the fourth plastic panel and extends across the M-shaped fold to be bonded to, or made integral with, the second matable section. This places the resealable closure outside the handle to enhance pouring of the product. Preferably, a defined frangible portion is disposed between the first and second matable sections substantially along a cusp of the outer bag M-shaped.

Further according to the present invention, a method of making a flexible plastic bag comprises the steps of (1) folding a first flexible sheet with a M-shaped fold to form an inner bag having front and rear panels and a gusset, (2) folding a second flexible sheet with a M-shaped fold outside of and parallel with the inner bag to form an outer bag having front and rear panels and a gusset, (3) bonding a resealable closure to the outer bag gusset substantially astride a cusp of the M-shaped fold, (4) bonding a handle to the outer bag, and (5) trimming and sealing the side edges of the inner and outer bags to form the flexible bag. Preferably, the resealable closure is bonded to the side edges of the bag in a manner to cause the resealable closure to project orthogonally from the outer bag top gusset when the bag is filled with product.

Also according to the present invention, a method of manufacturing a flexible plastic bag includes the steps of (1) folding a first plastic sheet with a M-shaped fold to form an inner bag having front and rear panels and a gusset, (2) folding a second plastic sheet with a M-shaped fold substantially coextensive with the inner bag to form an outer bag having front and rear panels and a gusset, (3) bonding a plastic resealable closure to the outer bag including the substeps of (a) bonding a first matable section to an outer surface of the outer bag front panel at a top portion of the outer bag M-shaped fold, and (b) bonding a second matable section to an outer surface of the outer bag gusset on an inwardly folded surface of the outer bag M-shaped fold adjacent the first matable section, and (4) bonding a plastic handle to the outer bag so as to extend across the outer bag M-shaped fold from the outer bag front panel to the outer bag rear panel. Preferably, the second matable section is bonded between the outer surface of the outer bag and an inner surface of the handle.

According to a further aspect of the present invention, a method of manufacturing a flexible plastic bag includes the steps of (1) folding a first plastic sheet with a M-shaped fold to form an inner bag having front and rear panels and a gusset, (2) folding a second plastic sheet with a M-shaped fold substantially co-extensive with the inner bag to form an outer bag having front and rear panels and a gusset, (3) bonding a plastic resealable closure to the outer bag including the substeps of (a) bonding a first matable section to an outer surface of the outer bag front panel at a top portion of the outer bag M-shaped fold, and (b) bonding a second matable section to an outer surface of the outer bag gusset on an inwardly folded surface of the outer bag M-shaped fold adjacent the first matable section, and (c) bonding a plastic handle to the outer bag so as to extend across the outer bag M-shaped fold from the outer bag rear panel to the second matable section. Preferably, a portion of the handle is integral with the second matable section. This structure places the resealable closure outside the handle to enhance a pouring of the product from the bag. Preferably, a defined frangible portion (such as a line of perforations) is formed in the outer bag between the first and matable sections of the plastic resealable closure.

Also, preferably, the structure and method according to the present invention includes an enhanced hermetically-sealed plastic container which includes double-sealing of the left and right side edges of the plastic bag, and providing diagonal seals at the left and right upper portions of the front and rear panels of the outer bag. These diagonal seals seal together the bag handle, the resealable closure, and the inner and outer bags in order to further enhance bag integrity while reducing pressure on the bag apex (the point where the bottom cusp of the M-shaped fold is bonded to the bag side edge).

BRIEF DESCRIPTION OF THE DRAWINGS

The advantageous structure, functions, and methods according to the present invention will be readily understood from the following detailed description of the preferred embodiments when taken together with the attached drawings.

FIG. 13 is a perspective view of a second embodiment according to the present invention.

FIG. 14 is a cross-section taken along lines 14–14 of FIG. 13.

DETAILED DESCRIPTION OF THE PREFERRED EMBODIMENTS

This invention relates preferably to bags of the general type that may be made, for example, from a continuous sheet of polymeric plastic which is first folded roughly in half lengthwise to create front and back panels and then folded inward lengthwise at the first fold, forming a gusset that connects the front and back panels. Of course, alternate folding patterns may be used. A second continuous sheet of polymeric plastic is processed as above and placed outside of and coextensive with the first plastic sheet. The first and second sheets may be folded simultaneously. The folded sheets of plastic are then cut and sealed crosswise at intervals to produce a plurality of duplex or double layered bags. When the bags are filled, they assume a roughly hexahedral shape. See, for example, the patents referred to above.

Figure 1:
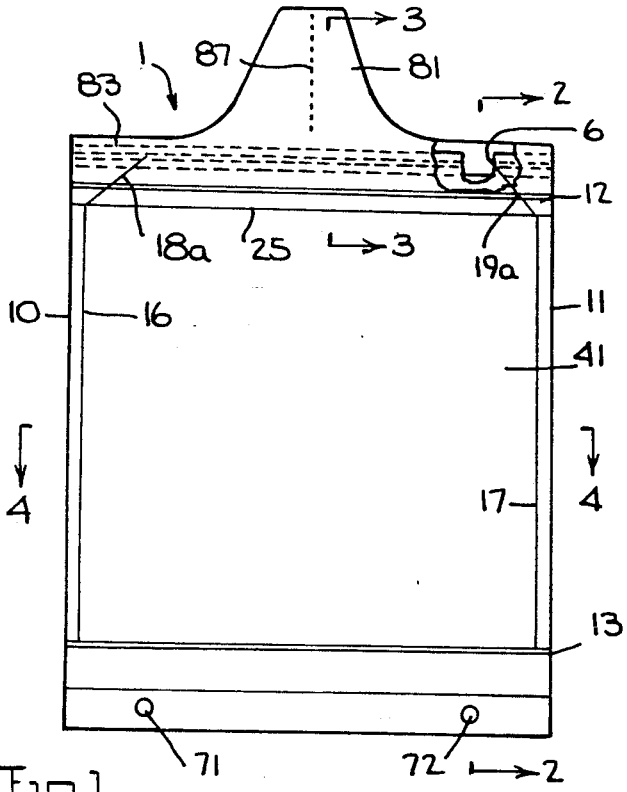
FIG. 1 is a front view of a preferred flexible bag according to a first embodiment of the present invention.
Figure 2:
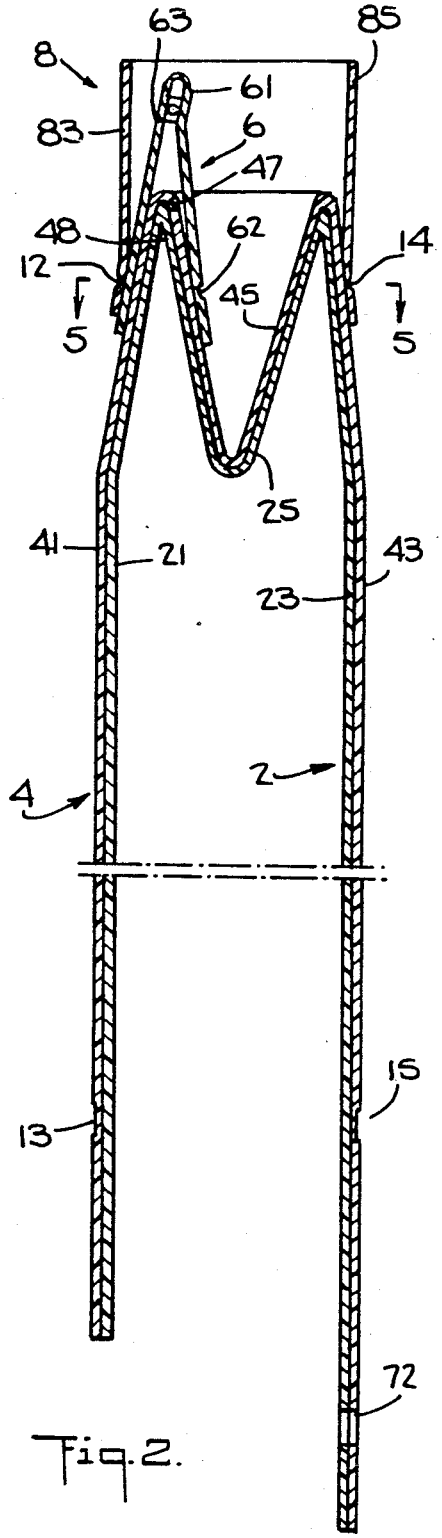
FIG. 2 is a cross-section taken along line 2—2 in FIG. 1.

Referring to the drawings wherein like numerals indicate like elements, there is shown in FIG. 1 a plastic bag 1 according to a preferred embodiment of the present invention. Referring simultaneously to FIGS. 1 and 2, the plastic bag 1 comprises an inner bag 2, an outer bag 4, a resealable closure 6, and a handle 8. The inner bag 2 comprises an inner front panel 21, an inner rear panel 23, and an inner gusset 25. Likewise, the outer bag 4 comprises an outer front panel 41, an outer rear panel 43, and an outer gusset 45. The inner bag 2 and the outer bag 4 are bonded together at the bag side edges 10 and 11, and also along four substantially horizontal bonding lines 12, 13, 14, and 15 at the top and bottom portions respectively of the front and rear sides of bag 1.

In order to ensure a substantially hermetic seal for the bag, the inner bag 2 and the outer bag 4 are also bonded together along vertical bonding lines 16 and 17. These bonding lines 16 and 17 are preferably one quarter of an inch inside the bag side edge seals 10 and 11, respectively. This space between the bonding lines 16, 17 and the bag side edge seals 10, 11 may comprise an air gap, or a solidly bonded area. In the preferred embodiment, the bonding lines 16 and 17 are ultrasonic seals which seal together all layers of plastic between the front and rear panels of the outer bag 4. To enhance hermetic sealing of the bag even further, the upper portion of the bag is bonded together along diagonal bonding lines 18*a* and 19*a* on the bag front, and 18*b* and 19*b* on the bag rear. Preferably, these bonding lines are also ultrasonic seals which bond together all plastic layers beneath the bonding lines. By using an ultrasonic seal, a strong bond between all layers is ensured. In fact, in the present embodiment, the ultrasonic diagonal seal seals together more than a 50 mil thickness of plastic. In particular, the diagonal ultrasonic seal of the present embodiment seals together 62 mils of thermoplastic. This unique thick ultrasonic seal provides further bag stability and ensures bag strength at the critical points. Bonding lines 18, 19 preferably make a 45 degree angle with the vertical bonding lines 16 and 17, respectively. Preferably, the bonding lines 18*a*, 18*b* intersect the vertical bonding line 16 at the apex of the bag (where the bottom cusp of the M-shaped fold is sealed to the bag side edge). The apex area is also sealed with a bar seal to produce triple sealing in this area (a bead seal, an ultrasonic seal, and a bar seal). This enhanced reinforcement of the bag apex ensures that the bag can bear great weight without failure at this critical point.

The purpose of the diagonal bonding lines 18, 19 is to increase the strength of the bag apex and further increase the bag's weight-bearing capability. The diagonal seals 18, 19 prevent product from entering the upper triangular areas of the bag when the product is being loaded therein with the bag hanging upside down. Since product is prevented from entering these areas, less pressure, abrasion, stress and strain are placed on the bag apex. Furthermore, the diagonal bonding lines 18, 19 effectively distribute the load from the handle 8 to the front and rear panels of the inner and outer bags in a more uniform fashion. While the preferred embodiment discloses bonding lines 18, 19, it will be readily understood that this diagonal sealing can be accomplished with a series of linearly-extending welding spots, or the entire corner of the bag may be welded together in a flat, triangular shape. This diagonal bonding also provides the bag, when filled with product, a better appearance than the bag would have without the diagonal bonding. The bag of this invention is a cleaner and a squarer bag when filled with product. This bonding together of the inner bag 2 and the outer bag 4 at these selected areas ensures that the flexible bag 1 maintains its structural strength and is capable of holding product of great weight therein while retaining the advantages of a duplex bag such as product freshness.

Preferably, the bottom of the flexible bag 1 is left open to allow the manufacturer to fill the bag with product, as is well-known in the art. Preferably, the outer and inner bag rear walls 43 and 23 are longer than the front walls and have wicket holes 71, 72 therein to support the bag while it is being filled. Preferably, also the outer bag is made of an opaque thermoplastic material so that product identification and advertising information can be printed thereon. Preferably, the inner bag 2 is a clear thermoplastic material to allow visible identification of the product therein after access has been gained through the outer bag gusset 45, as will be described later.

Resealable enclosure 6 preferably comprises a tongue-and-groove assembly comprising male and female matable sections, commonly known in the market as a ZIP-lock TM. In the first embodiment, the first matable section 61 is bonded at a bonding line 62 to an inwardly folded portion of the outer gusset 45, as shown in FIG. 2. Likewise, the second matable section 63 is bonded to the top portion of outer bag front panel 41 opposite the first matable section 61 at bonding line 12. Note that the second matable section is interposed between the outer bag front panel 41 and a portion of handle 8. This ensures a constant relationship between the resealable closure 6 and the handle 8 and the outer bag 4 so that the resealable closure 6 stands substantially orthogonal to the outer bag gusset 45 when the bag is filled with product. By ensuring that the resealable closure 6 stands orthogonally, access to the first and second matable sections 61 and 63 is made very easy and convenient for the user. Furthermore, pouring product from the bag is simpler since the resealable closure 6 is not folded flat against the outer bag gusset 45. Preferably, a single bonding line 12 is used to bond both the handle 8 and the second matable section 63 to the upper portion of the outer bag front panel 41.

Figure 3:
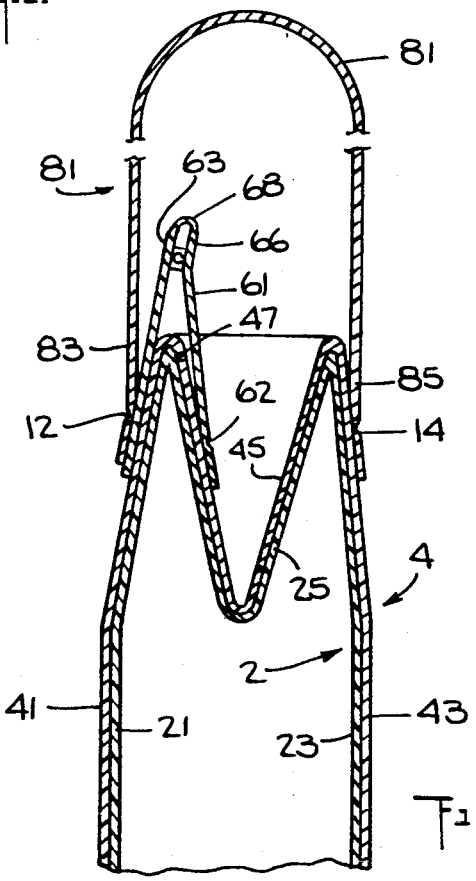
FIG. 3 is a cross-section taken along line 3—3 in FIG. 1.

As shown in FIG. 3, the first matable section 61 and the second matable section 63 may be integral with a connecting portion 66 which may have one or more defined frangible portions (such as a line of perforations) 68 therein. To gain access to the bag, the user first tears the resealable closure 6 along the defined frangible portion(s) 68 in order to separate the first and second matable sections 61, 63. This additional portion 66 provides a visual indication of any product tampering which may have occurred prior to use.

For gaining access to the interior of the bag, a defined frangible portion 47 may be provided in the outer bag gusset 45 along or adjacent the cusp of the left portion of the M-shaped fold, generally between first and second matable sections 61 and 63. This defined frangible portion may comprise a line of perforations, a thinned section of plastic, a chemical etching of the plastic material, a painted or printed line, a scribed line, or printed instructions, or any other known or convenient way of making this section of the outer bag gusset 45 more readily frangible. The defined frangible portion may also comprise the location of the plastic which makes it more accessible for tearing. For example, the portion of the outer gusset 45 that is between the first and second matable section 61, 63 is a defined frangible portion by virtue of its location. The user knows that this portion of the plastic bag is specifically intended to be torn in order to gain access to the interior of the bag. In the preferred embodiment, however, the defined frangible portion is a line of perforations so that, in FIG. 2, the inner bag gusset 25 adjacent the defined frangible portion 47 is less frangible relative to the defined frangible portion 47 of the outer bag gusset 45. The inner bag 2 may also have a defined frangible portion 48 therein, but preferably, it will be less frangible than the defined frangible portion 47.

To gain access to the bag, the outer bag gusset 45 is ripped along the defined frangible portion 47. Then, the inner bag gusset 25 must be torn with fingers, scissors, or another object. This preferred combination of superposed defined frangible portion and less frangible portion ensures easy access to the bag while making sure that the product within the bag is fresh. For example, even if the defined frangible portion 47 is inadvertently torn during manufacturing, shipping, or transportation, the product within the bag will retain its freshness since the inner bag 2 remains substantially air-tight. It has also been discovered that the placement of the defined frangible portion 47 on or adjacent the cusp of the M-shaped fold provides two funnel-like structures for product to exit from the bag. This may enhance the pourability of the product, allowing the user to pour product from the bag with less spillage than with known bags.

Referring now to FIGS. 1, 2, and 3, the handle 8 of the bag 1 generally comprises a grip section 81, a front support section 83, and a rear support section 85. Note that the front support section 83 terminates only slightly above the top portion of first and second matable sections 61 and 63 of resealable closure 6. This protects the resealable closure 6 from damage or debris, and supports the resealable closure 6 in the orthogonally-projecting position described above. Note that the front support section 83 of handle 8 is bonded to the second matable section 63, while the rear support section 85 of handle 8 is bonded to the outer bag itself at rear panel 43. The handle support sections 83 and 85 act to distribute the weight of the bag along the upper portion thereof. By so distributing the load, the bag can support great weight without ripping or tearing at the handle-bag interface.

The handle 8 has a defined frangible portion 87 extending across the grip section 81 from a front portion to a rear portion thereof. Preferably, the defined frangible portion 87 extends across the handle from substantially the top of support section 83 to the top of support section 85. This defined frangible portion may be used to provide easy access to the top portion of the bag. Preferably, the height of the grip section 81 and the depth of the defined frangible portion 87 are predetermined to allow the user to stretch the two handle sections over the bag ends after the handle has been torn along the defined frangible portion 87. Specifically, each of the torn handle sections is pulled over a bag side edge 10, 11 in order to expose the bag top. When a large quantity of pet food, (e.g., 40 lbs.) is stored within such a bag, the user will most likely scoop the product from the bag rather than pour it. The predetermined height of grip section 81 and the depth of defined frangible portion 87 are specifically designed to offer convenient access to the top of the bag.

Figure 4:
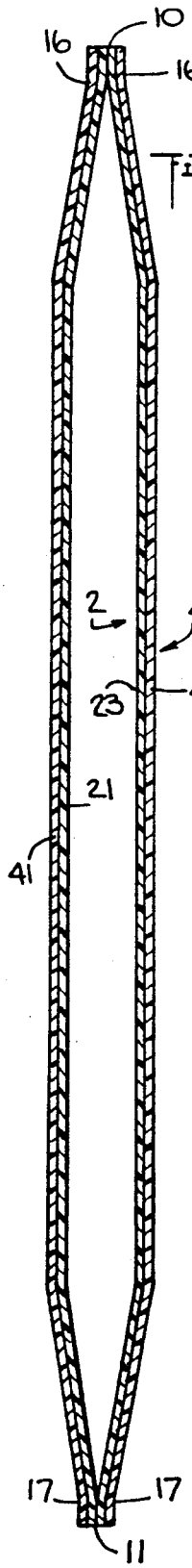
FIG. 4 is a cross-section taken along line 4—4 in FIG. 1.
Figure 5:
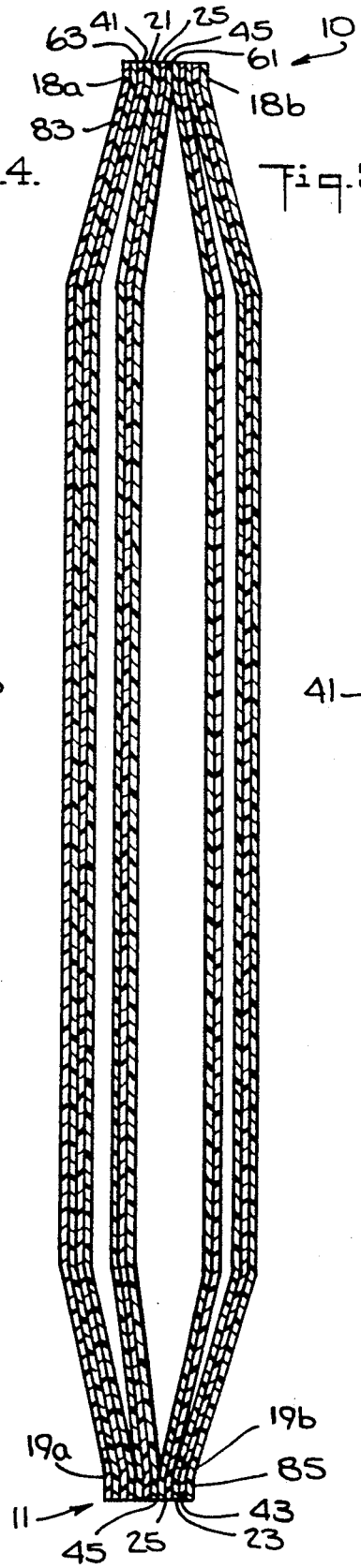
FIG. 5 is a cross-section taken along lines 5—5 in FIGS. 1 and 2.

Turning now to FIGS. 4 and 5, cross-sectional views of the FIG. 1 bag taken along lines 4—4 and 5—5 are provided. In FIG. 4, the side edges 10, 11 of the inner and outer bags 2, 4 are bonded together at their distal ends 10, 11 and at bonding lines 16, 17. Specifically, the side edges of inner front and rear panels 21, 23 are sealed together and sandwiched between the side edges of outer front and rear panels 41 and 43. Thus, the inner and outer bags 2, 4 are sealed together along the entire side edges of the bag, again adding structural support to the bag.

In FIG. 5, the cross section is taken along line 5—5 passing just below both cusps of the M-shaped fold in FIGS. 1 and 2. Thus, the first (leftmost) plastic layer comprises handle front support section 83 which is adjacent to second matable section 63. Inside second matable section 63 is a top portion of outer bag 41, followed by a top portion of inner bag 21. In this location, the sections 83, 63, 41, and 21 are all bonded together along the horizontal bonding line 12. The next group of sections comprises the inner bag gusset 25, the outer bag gusset 45, and the first matable section 61. In this location, the first matable section 61 and the outer bag gusset 45 are bonded together along horizontal bonding line 62, while the inner bag gusset 25 is relatively free to move with respect to the outer bag gusset 45.

Toward the rear of the flexible bag, and referring to the bottom portion of FIG. 5, the outer bag gusset 45 and the inner bag gusset 25 are depicted in a two-section group. At this location, these panels are movable relative to each other. The rear-most three section group includes a top portion of the inner bag rear panel 23, a top portion of the outer bag rear panel 43, and handle rear support section 85. At this location, all three of these panels are bonded together along horizontal bonding line 14.

In FIG. 5, the diagonal bonding lines **18*a*, 18*b*, and 19*a*, 19*b* are shown. These bonding lines preferably seal together all layers of plastic therebeneath. Specifically, the diagonal bonding lines 18*a* and 19*a* preferably bond together the sections 83, 63, 41, 21, the left-most portions of sections 25 and 45, and section 61. In a like fashion, the diagonal bonding lines 18*b*, 19*b* bond together sections 85, 43, 23, and the right-most portions of sections 25 and 45**.

Figure 6:
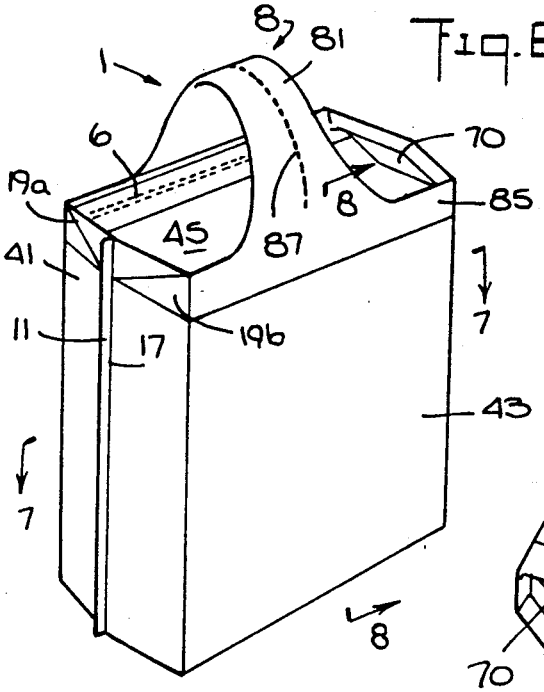
FIG. 6 is a perspective showing the FIG. 1 bag filled with product.

FIG. 6 is a perspective view of the FIG. 1 bag taken from the rear when the bag is filled with product. Outer bag front and rear panels 41, 43, are bonded together at side edge 11, as described above. The vertical bonding line 17 is just inside the seal at the side edge 11, thus presenting a small flange which protrudes from the side edge of the bag in the manner shown. The diagonal bonding lines 19*a* and 19*b* are seen protruding from the vertical bonding line 17 in substantially 45 degree angles toward the upper corners of the left side of the bag. The intersection of the bonding line 17, 19*a*, and 19*b* is substantially adjacent the bag apex, where the bottom cusp of the M-shaped fold intersects the bag side edge 11. The resealable closure 6 stands upright and is disposed along one side edge of the flexible bag 1 toward one side of the outer bag gusset 45. A downward extending triangular-shaped pocket 70 is formed adjacent each side edge 10, 11 in the outer bag gusset 45 when the bag is filled with product. Thus, the filled bag 1 presents a substantially hexahedral shape convenient for storing and shipping the product.

Figure 7:
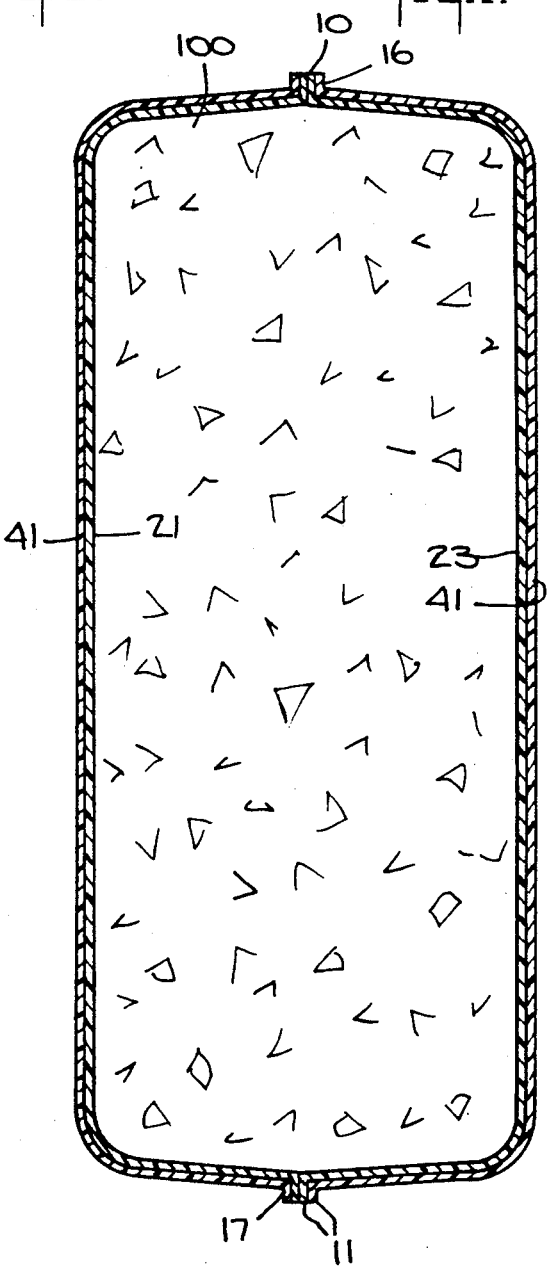
FIG. 7 is a cross-section taken along line 7—7 in FIG. 6.

FIG. 7 is a cross-section taken along lines 7—7 of FIG. 6. In FIG. 7, product 100 is stored between the inner bag front and rear panels 21, 23. The rectangular shape of the filled bag is clearly viewed and is a characteristic feature of the preferred embodiments. The side edge seals 10 and 11 are preferably bead and bar seals known as LIMO seals to those of skill in this field. These double-type seals add to the structural integrity of the bag and ensure product freshness. The vertical bonding lines 16, 17 are respectively inside the side edge seals 10, 11 and offer an additional seal to the bag side edges, as has been described above.

Figure 8:
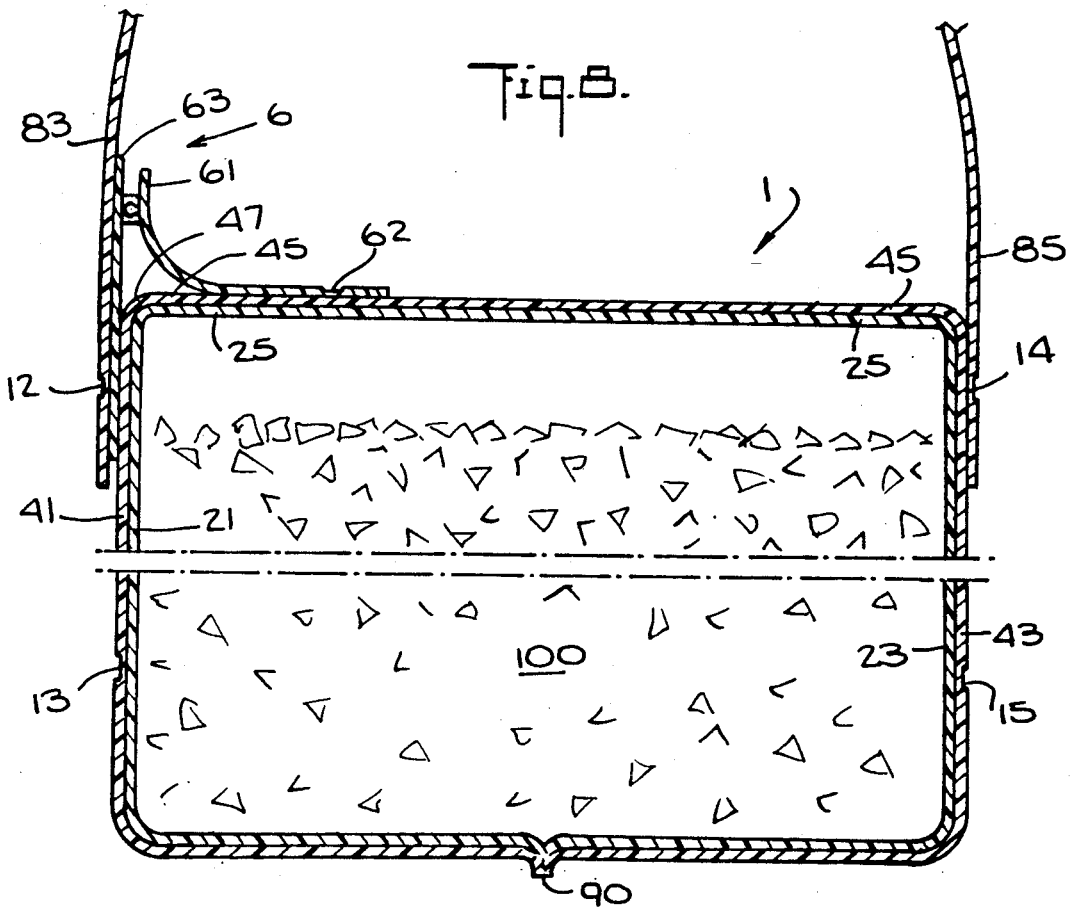
FIG. 8 is a cross-section taken along line 8—8 in FIG. 6.

FIG. 8 is a cross-section taken along lines 8—8 of FIG. 6. It can be seen that when the bag 1 is filled with product, the M-shaped folds in the inner and outer gussets 25, 40 are substantially flattened and made horizontal. It can be seen that the resealable closure 6 stands substantially orthogonal to the gussets 25 and 45. This is because the resealable closure 6 is sealed to both the left and right side edges 10, 11, and is also sealed between the handle front support section 83 and the top portion of outer bag front panel 41. By thus bonding the resealable closure 6 in both horizontal and vertical planes, the position of resealable closure 6 is constrained to be substantially vertical. As mentioned above, this configuration of resealable closure 6 is most advantageous to the user in gaining access to the bag and in pouring product from the bag. In FIG. 8, note that the defined frangible portion 47 lies approximately at the 90 degree angle where the bag gussets turn into the bag front panels. This location of the defined frangible portion 47 further adds to the ease and accuracy with which the product may be poured from the bag.

At the bottom of FIG. 8 is a bottom seal 90 which may be made by the product manufacturer after the product has been inserted into the bag from the bottom. Bottom seal 90 may be any known or convenient seal such as the LIMO seal mentioned above.

Figure 9:
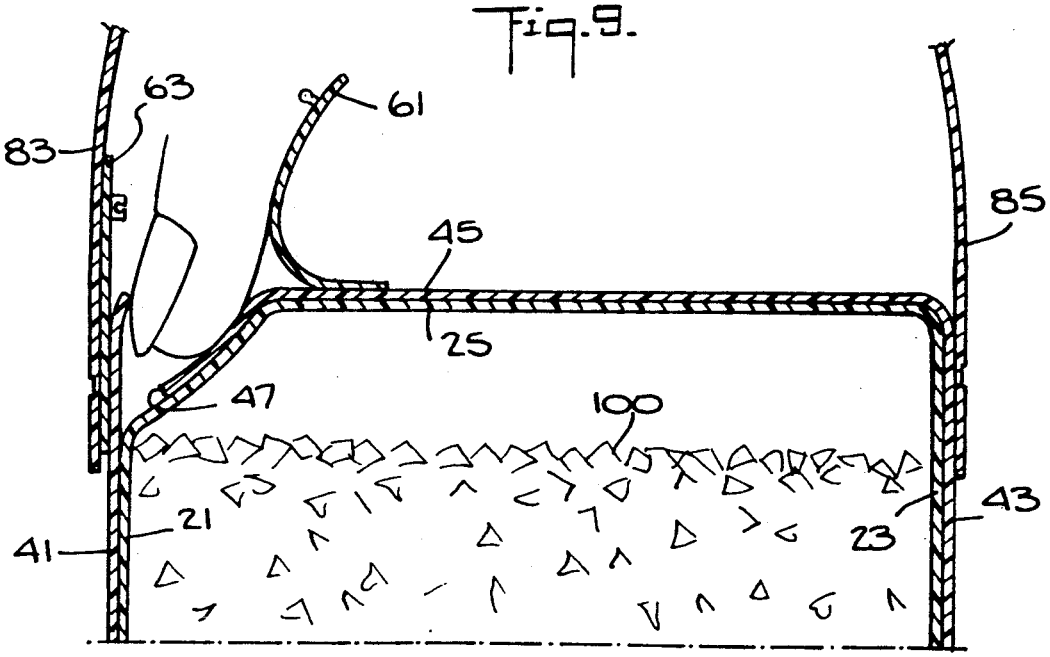
FIG. 9 is a close-up schematic depicting the method of accessing the product within the FIG. 6 bag.

FIG. 9 is a schematic view generally similar to FIG. 8 depicting the ease with which access is gained to the interior of the bag. Initially, the user may separate the grip section 81 of handle 8 along defined frangible portion 87 (see FIG. 10). Next, the user separates resealable closure 6 into the first and second matable sections 61, 63. Then, the user rends the outer bag at defined frangible portion 47 as is shown. At this point, the product 100 is clearly visible through the clear thermoplastic inner bag 2. Product freshness is retained since the inner bag at this point is preferably less frangible than the defined frangible portion 47. If the user desires to gain access to the product, the inner bag 2 is torn at this point using a sharp object such as scissors, a fingernail, a key, or by gripping and tearing the bag.

Figure 10:
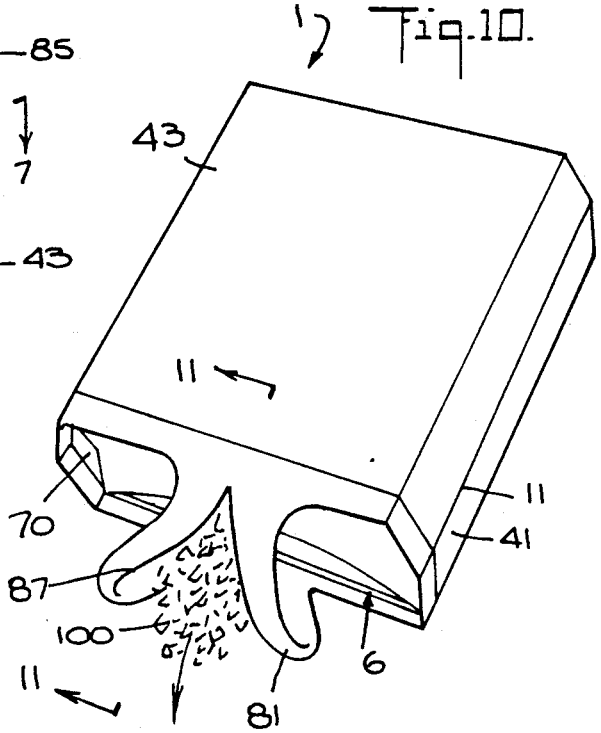
FIG. 10 is a perspective showing product being poured from the FIG. 6 bag.

FIG. 10 shows one way in which product may be conveniently poured from the bag opened according to the description given above with respect to FIG. 9. Specifically, the bag 1 may be up-ended and product will egress through resealable closure 6 and between the two portions of the handle grip section 81. With larger-quantity bags, the user at least initially may merely desire to scoop product from a vertically-standing bag. In this instance, the two portions of grip section 81 may be pulled over the side edges 10, 11 of bag to conveniently store the handles away from the bag top. Now, continuous free access to the resealable closure 6 is ensured.

Figure 11:
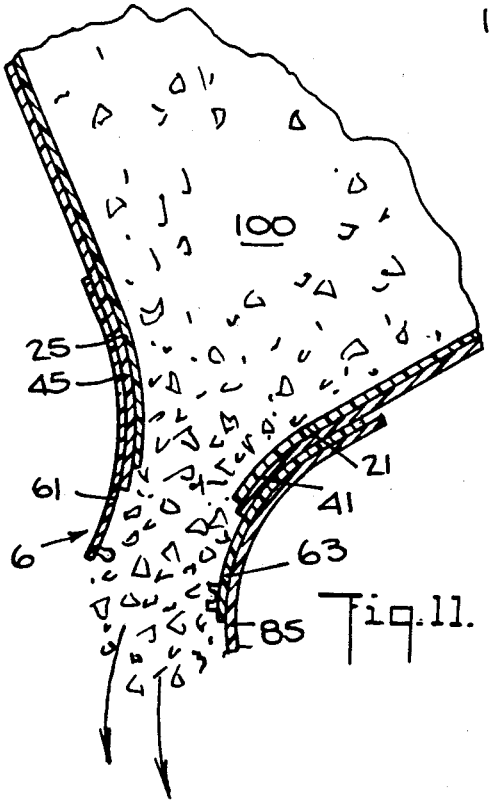
FIG. 11 is a partial cross-section taken along line 11—11 of FIG. 10.

FIG. 11 is a partial cross-section of FIG. 10 taken along line 11—11 thereof. In this close-up view, the product 100 is seen exiting the bag between the inner and outer bags and the resealable closure. Since the defined frangible portion 47 and the resealable closure 6 are disposed in an upper corner of the bag, the point of egress from the bag is substantially funnel-shaped, which may facilitate the pouring operation.

Figure 12:
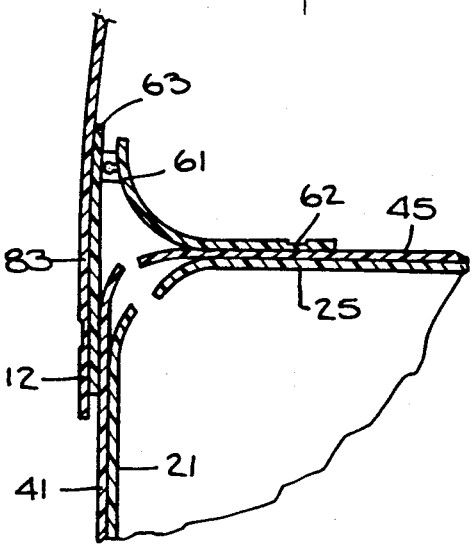
FIG. 12 is a close-up schematic depicting a resealed FIG. 6 bag after product has been poured therefrom.

When a sufficient portion of product has been poured from the bag, or when the bag is empty, the bag can be resealed to be substantially airtight, as depicted in FIG. 12. This is accomplished by merely resealing first and second matable sections 61, 63 along their entire lengths between the side edges 10 and 11. Even though the inner and outer bags are now punctured, the sealing of the resealable closure 6 tends to help the product within the bag to retain its freshness and to be again transported without spillage.

A second embodiment of the present invention is depicted in FIGS. 13 and 14. In this embodiment, the resealable closure 6 is positioned outside of the handle in order to provide easier pouring for the user. This embodiment is designed particularly for smaller quantity bags, such as those storing about 4–15 pounds of pet food. In FIG. 13, product 100 is being poured from the bag through resealable closure 6 which is outside handle 8. The resealable closure second matable section 63 is bonded to the outer surface of the upper portion of outer bag front panel 41 as in the FIG. 1 embodiment. However, (as is seen in FIG. 14), the first matable section 62 is bonded to, or more preferably (as seen in FIG. 14), made integral (formed in one piece) with handle support section 83 to form a unified matable support structure 86 welded to the outer surface of outer bag gusset 45. The matable sections of the resealable closure 6 still form an angle with respect to each other in order to enhance the pouring operation.

FIG. 14 is a cross-sectional view of the FIG. 13 bag taken along line 14—14 thereof. The handle rear support section 85 is bonded to the outer surface of the upper portion of the outer bag rear panel 43 as with the FIG. 1 embodiment. However, the handle front portion 83 is preferably made integral with a first matable section 62 of the resealable closure, and is bonded to the outer bag gusset 45. Alternatively, the handle does not have to be made integral with the resealable closure 6, and a separate second matable section 62 may be provided to which the handle front support section 83 would be bonded. As with the FIG. 1 embodiment, two angled plastic surfaces lie beneath the two portions of resealable closure 6. This structure ensures freshness and enhances pourability.

To control the pouring operation even more, the resealable closure may include one or more welds 69 (FIG. 13) which weld together the first and second matable sections 62 and 63 in order to confine the opening in the resealable closure 6 to a small portion thereof. For example, two welds 69 may be provided on either side of handle 8 to provide a smaller pouring channel from the bag. Of course, the number and placement of the welds will vary depending upon the product to be poured.

The bonding lines of the second embodiment are generally similarly located to those of the first embodiment. However, the bonding line 12 only bonds together the second matable section 63, the outer bag front panel 41, and the inner bag front panel 21. The bonding line 62 bonds together the matable support structure 86 and the outer bag gusset 45 and the inner bag gusset 25. Of course, all bonding lines described in the specification may comprise equivalent structures such as bonding/portions, welding spots, areas, etc. The bonding preferably includes thermoplastic welding, but may comprise gluing, grommets, etc.

A method of manufacturing the bag according to the FIG. embodiment will now be described with reference to FIGS. 15–18.

Figure 15:
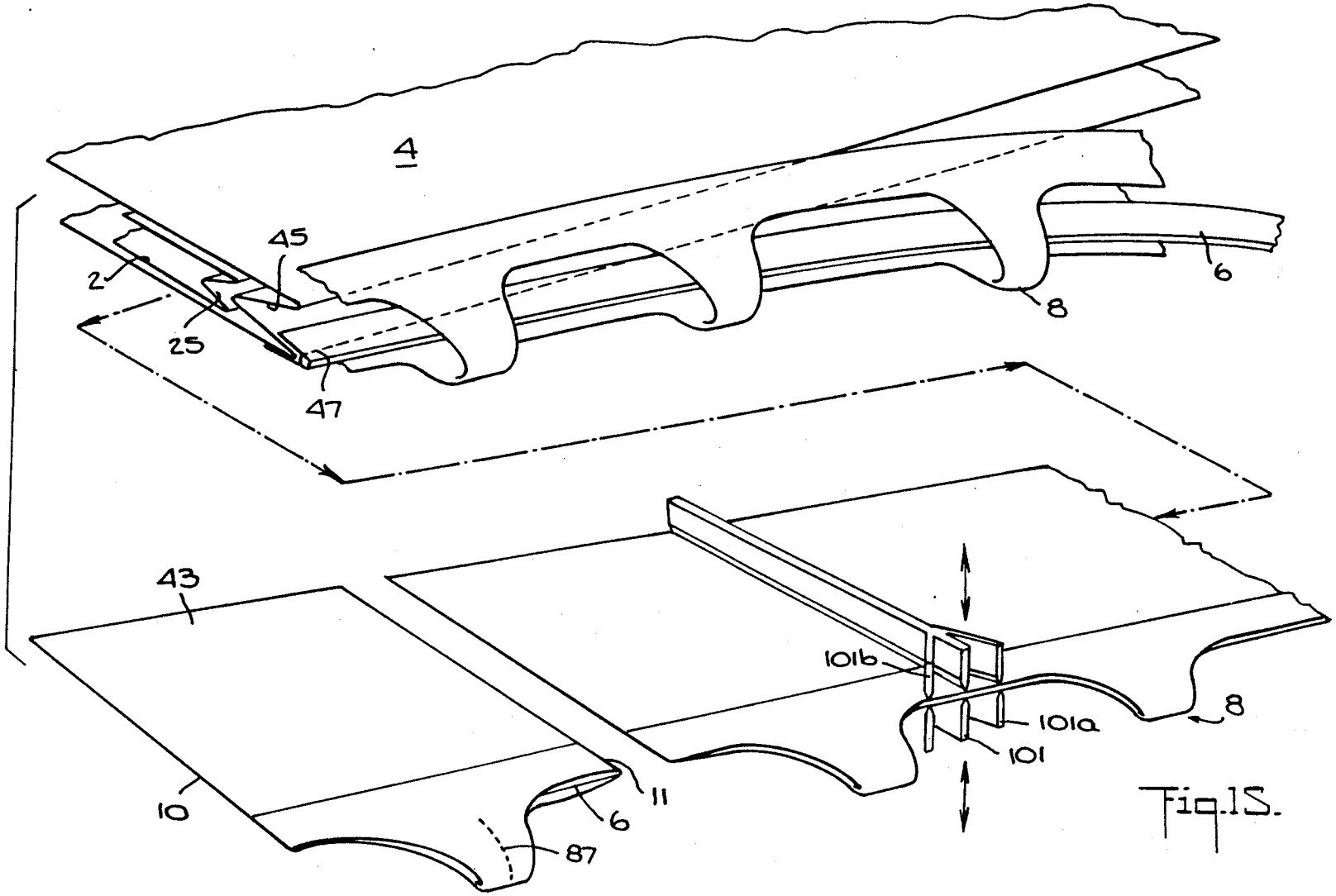
FIG. 15 is a perspective view of the method of manufacturing a plurality of FIG. 1 bags.

In FIG. 15, the sheet of plastic comprising the outer bag first has the defined frangible portion 47 formed at the appropriate location therein, if the defined frangible portion comprises more than just a defined location. Next, the resealable closure 6 is adhered to the still-flat outer bag 4 astride the defined frangible portion 47. Thereafter, the inner bag 2 is joined to the inside surface of the outer bag 4, preferably by bonding along the bonding lines 13 and 15. Then, the adjoined inner and outer bags 2, 4, are folded at their center portion to provide the characteristic M-shaped fold in which the defined frangible portion and the resealable closure are on, adjacent, or astride one cusp the M-shaped fold.

The handle 8 is then provided and is located so as to bridge the M-shaped fold of the outer bag 4. The handles may be preformed before disposing them on the bag, or, alternatively, a continuous sheet of plastic may be formed over the bag end with the cutting and trimming of the handle sections to be carried out at a later stage. The defined frangible portion of the handle 8 may be formed either before or during the cutting and trimming operations. Preferably, it is formed in the plastic sheet which comprises handles 8 before the plastic sheet is folded over the M-shaped fold of the outer bag 4.

With the inner and outer bags, the resealable closure, and the handle portion all appropriately located, the trimming and sealing operations can be carried out. In some cases, the trimming and sealing can be carried out simultaneously using a hot knife 101, as with the side edges of the bag. In the case of the horizontal bonding lines 12, 14, and 62, these can be formed with well-known apparatus either during or after the bag folding operations. In FIG. 15, hot knife 101 is seen to comprise a Y-shaped structure in which the two arm portions 101*a*, 101*b* form the diagonal bonding lines 18, 19. These upper arm portions do not cut through the bag, but only bond the plastic surfaces thereunder. Preferably, the diagonal bonding lines 18, 19 are formed with an ultrasonic process rather than the hot knife process. Also at this stage, the bonding lines 16, 17 are formed with an ultrasonic process substantially one quarter of an inch inside the bag side edges 10, 11. After the above-described steps, a plurality of separate duplex bags are provided by cutting and sealing along the side edges 10 and 11.

Figure 16:
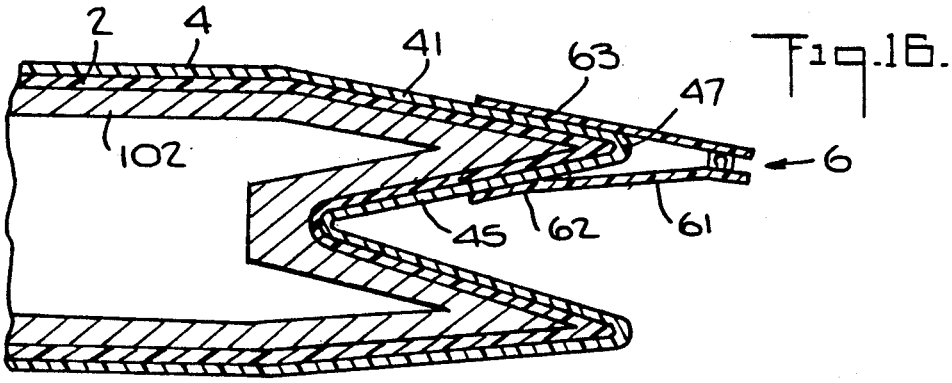
FIGS. 16–18 are cross-sections depicting the various steps of manufacturing bags according to FIG. 13.
Figure 17:
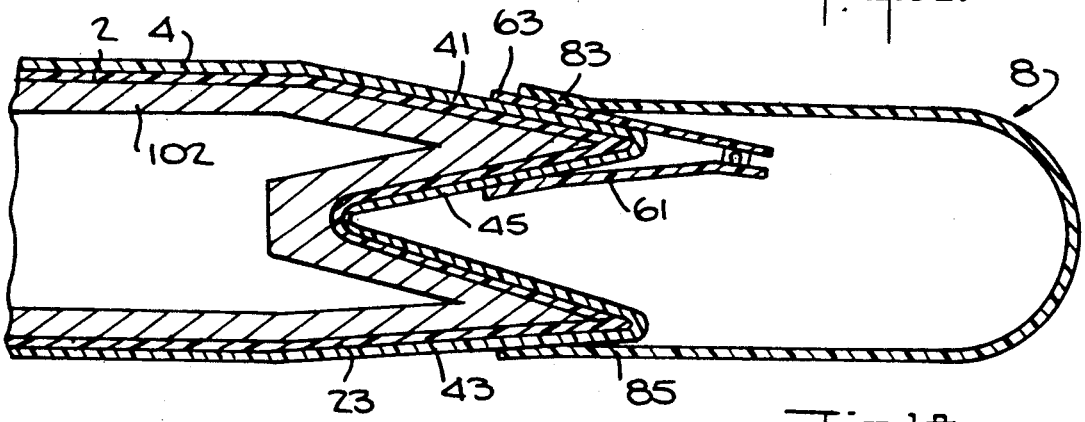
Figure 18:
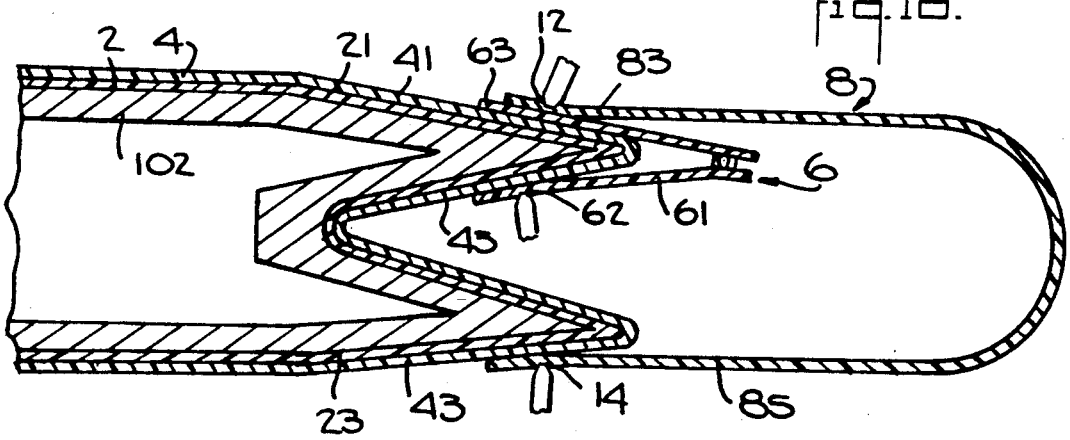

Turning now to FIGS. 16–18, a more detailed description of the above-described process will be provided In FIG. 16, the adjoined inner and outer bags 2, 4 are folded with a M-shaped device 102 such that the resealable closure 6 and the defined frangible portion 47 are adjacent/astride one cusp of the M-shaped fold. Bonding of the first matable section 61 to the outer bag gusset 45 along bonding line 62 may take place at this stage or a later stage.

In FIG. 17, the handle portion 8 is located so as to bridge the M-shaped fold in the manner shown.

In FIG. 18, the sealing of the top portion of the bag may be performed by well-known procedures along bonding lines 12, 14, and 62. The bonding is performed such that at bonding line 12, the handle section 83, the second matable section 63, the outer bag front panel 41, and the inner bag front panel 21 are all sealed together. At bonding line 14, only the first matable section 61 and the outer bag gusset 45 are bonded together. At bonding line 65, the handle rear section 85, the outer bag rear panel 43, and the inner bag rear panel 23 are all bonded together. The sealing of the bag along bonding lines 13 and 15 can take place simultaneously to the above-described bonding or at an earlier stage. Furthermore, the trimming and sealing of the side edges 10 and 11 can take place at the same stage, or subsequent thereto.

The method of manufacturing the bag according to the second embodiment of FIGS. 13 and 14 is generally similar to the method of making the FIG. 1 bag. However, when the resealable closure 6 is adhered to the outer bag, the closure includes the matable support structure 86 and the sheet which comprises the handle 8. At a later stage, the sheet comprising handle 8 is folded across the M-shaped structure and then bonded to the outer bag 4 at rear panel 43. The remaining steps are then similar to those described above with respect to FIGS. 16–18.

The methods described above are not constrained to the sequences disclosed. Those of skill in this field would readily perceive that a wide variety of manufacturing sequences may be adopted within the outlines of the methods presented above.

The present invention may be embodied in other specific forms without departing from the spirit or essential attributes thereof, and, accordingly, reference should be made to the appended claims rather than to the foregoing specification as indicating the scope of the invention.

I claim:

1. A flexible bag comprising:

an outer bag having (a) front and rear panels connected together at side edges thereof, and (b) a gusset connecting together top portions of said front and rear panels;

an inner bag substantially coextensive with the outer bag and having (a) front and rear panels connected together at side edges thereof, and (b) a gusset connecting together top portions of the inner bag front and rear panels;

a resealable closure connected to the outer bag gusset astride a location where the outer bag gusset joins the outer bag front panel; and a handle bonded to the outer bag and bridging the outer bag gusset.

2. A bag according to claim 1, wherein the outer bag, the inner bag, the resealable closure, and the handle all consist essentially of a thermoplastic material.

3. A bag according to claim 1, wherein said outer bag gusset includes a defined frangible portion located beneath the resealable closure.

4. A bag according to claim 1, wherein the resealable closure is bonded to the side edges of the outer bag in a manner to cause the resealable closure to project substantially orthogonally from a top surface of the outer bag gusset when the flexible bag is filled with product.

5. A bag according to claim 4, wherein the resealable closure is substantially adjacent the outer bag front panel but spaced from the outer bag rear panel when the flexible bag is filled with product.

6. A bag according to claim 1, wherein the outer bag and the inner bag are bonded together at top and bottom portions of their respective front and rear panels.

7. A bag according to claim 1, wherein the resealable closure comprises:

a first mating portion connected to an outer surface of the outer bag front panel; and a second mating portion connected to an outer surface of an inner fold of the outer bag gusset adjacent the first mating portion.

8. A bag according to claim 7, further comprising a defined frangible portion disposed on said outer bag between the first and second mating portions and along an outer fold between the outer bag front panel and the outer bag gusset.

9. A bag according to claim 7, wherein the first mating portion is disposed between the outer bag front panel outer surface and the handle.

10. A bag according to claim 1, wherein the resealable closure comprises:

a first mating portion connected to an outer surface of the outer bag front panel; and a second mating portion coupled to said handle and connected to an outer surface of an inner fold of the outer bag gusset adjacent the first mating portion.

11. A bag according to claim 10, wherein the second mating portion is integral with the handle.

12. A bag according to claim 10, further comprising a defined frangible portion disposed on said outer bag between the first and second mating portions and along an outer fold between the outer bag front panel and the outer bag gusset.

13. A bag according to claim 1, wherein the handle includes a defined frangible portion extending in a direction from the outer bag front panel to the outer bag rear panel, and wherein the handle defined frangible portion has a depth and the handle has a length predetermined to allow two handle portions separated along the handle defined frangible portion to be pulled over respective left and right side edges of the bag when filled with product.

14. A bag according to claim 1, wherein the outer bag side edges are bonded together with (1) left and right outer side edge seals at the distal side edges of the outer bag, and (2) left and right inner side edge seals respectively disposed inside and substantially parallel to the left and right outer side edge seals.

15. A bag according to claim 14, further comprising two diagonal seals on each side edge of the outer bag, each diagonal seal extending diagonally from a respective corner of the bag when filled to a corresponding inner side edge seal.

16. A bag according to claim 15, wherein said diagonal seals and said inner side edge seals comprise ultrasonic seals.

17. A bag according to claim 16, wherein said diagonal seal ultrasonic seal bonds together more than 50 mils of plastic.

18. A bag according to claim 15, wherein the diagonal seals bond together the outer bag, the inner bag, the outer bag gusset, the inner bag gusset, the handle, and the resealable closure.

19. A flexible bag consisting essentially of plastic and comprising:

an inner bag including first and second plastic panels bonded together at side edges thereof;

an outer bag including third and fourth plastic panels bonded together at side edges thereof;

inner and outer gussets respectively integral with top portions of the inner and outer bags, each respective gusset and bag having a M-shaped fold;

a plastic resealable closure having (a) a first matable section disposed on an outer surface of the outer bag third plastic panel at a top portion of the M-shaped fold, and (b) a second matable section disposed on an outer surface of the outer bag gusset on an inwardly folded surface of the M-shaped fold adjacent the first matable section; and a plastic handle bonded to an outside surface of the outer bag and extending across the M-shaped folds from the outer bag third panel to the outer bag fourth panel.

20. A bag according to claim 19, wherein the first and second matable sections are each bonded to the side edges of the outer bag in a manner to cause a middle portion of the resealable closure to be substantially non-parallel with the outer bag gusset when the flexible bag is filled with product.

21. A bag according to claim 19, wherein the outer bag gusset has a defined frangible portion disposed between the first and second matable sections.

22. A bag according to claim 21, wherein the inner bag gusset has a defined frangible portion disposed between the first and second matable sections.

23. A bag according to claim 21, wherein the inner bag gusset has an outer surface substantially less frangible than the defined frangible portion of the outer bag gusset.

24. A bag according to claim 19, wherein the inner and outer bags are bonded together at their respective side edges with (1) a first seal at distal portions of the bag side edges, and (2) a second seal disposed inside the first seal to cause a flange to protrude from each side edge of the outer bag.

25. A bag according to claim 24, further comprising first and second diagonal seals at each side edge of the outer bag, each diagonal seal extending from a respective bag corner when the bag is filled to a corresponding second seal at a location where a bottom cusp of the outer bag M-shaped fold intersects the corresponding outer bag side edge.

26. A bag according to claim 25, wherein each first diagonal seal seals together the outer bag third panel, the inner bag first panel, the outer bag gusset, the inner bag gusset, the resealable closure, and the handle.

27. A bag according to claim 26, wherein each second diagonal seal seals together the outer bag fourth panel, the inner bag second panel, the outer bag gusset, the inner bag gusset, and the handle.

28. A bag according to claim 19, wherein the first matable section is bonded to the third plastic panel outer surface, and wherein the handle is bonded to an outer surface of the first matable section and to an outer surface of the fourth plastic panel.

29. A flexible bag consisting essentially of plastic and comprising:

an inner bag including first and second plastic panels having a gusset therebetween to form a M-shaped fold, the first and second plastic panels being connected together at side edges thereof;

an outer bag including third and fourth plastic panels having a gusset therebetween to form a M-shaped fold, the third and fourth plastic panels being bonded together at side edges thereof;

a plastic resealable closure having (a) a first matable section disposed on an outer surface of the outer bag third plastic panel at a top portion of the M-shaped fold, and (b) a second matable section disposed on an outer surface of the outer bag gusset on an inwardly folded surface of the M-shaped fold adjacent the first matable section; and a plastic handle bonded to an outside surface of the outer bag and extending from the outer bag fourth panel to the outer bag gusset adjacent the second matable section.

30. A bag according to claim 29, wherein the handle is integral with the second matable section of the resealable closure.

31. A bag according to claim 29, wherein the first and second matable sections are each bonded to the side edges of the outer bag in a manner to cause a middle portion of the resealable closure to be substantially non parallel with the outer bag gusset when the flexible bag is filled with product.

32. A bag according to claim 29, wherein the outer bag gusset has a defined frangible portion disposed between the first and second matable sections, wherein the defined frangible portions comprises a line of perforations disposed along a cusp of the outer bag M-shaped fold.

33. A bag according to claim 29, wherein the inner and outer bags are bonded together at their respective side edges with (1) a first seal at distal portions of the bag side edges, and (2) a second seal disposed inside the first seal to cause a flange to protrude from each side edge of the outer bag.

34. A bag according to claim 33, further comprising left and right diagonal seals disposed on upper portions of the outer bag third and fourth panels, each diagonal seal extending from a respective upper corner of the bag when filled to a corresponding second seal.

35. A bag according to claim 29, wherein said resealable closure includes first and second spaced-apart welds in a middle portion thereof to restrict the area of the resealable closure which may be opened.

* * * * *

UNITED STATES PATENT AND TRADEMARK OFFICE

CERTIFICATE OF CORRECTION

PATENT NO. : 5,221,143

DATED : June 22, 1993

INVENTOR(S) : HARRY R. PEPPIATT

It is certified that error appears in the above-indentified patent and that said Letters Patent is hereby corrected as shown below:

COLUMN 2

Line 56, "a" should read --an--.

COLUMN 3

Line 10, "a" should read --an--.
Line 24, "M-shaped." should read --M-shaped fold.--.
Line 27, "a M-shaped" should read --an M-shaped--.
Line 29, "a M-" should read --an M- --.
Line 43, "a M-shaped" should read --an M-shaped--.
Line 45, "a M-" should read --an M- --.
Line 64, "a" should read --an--.
Line 66, "a" should read --an--.

COLUMN 4

Line 45, "lines 5-5" should read --line 5-5--.
Line 46, "FIGS. 1 and 2." should read --FIG. 2.--.
Line 63, "lines 14-14" should read --line 14-14--.

UNITED STATES PATENT AND TRADEMARK OFFICE

CERTIFICATE OF CORRECTION

PATENT NO. : 5,221,143

DATED : June 22, 1993

INVENTOR(S) : HARRY R. PEPPIATT

It is certified that error appears in the above-indentified patent and that said Letters Patent is hereby corrected as shown below:

COLUMN 7

Line 20, "section 61, 63" should read --sections 61, 63--.

COLUMN 9

Line 7, "line 17," should read --lines 17,--.
Line 18, "lines 7-7" should read --line 7-7--.
Line 30, "lines 8-8" should read line 8-8--.
Line 33, "25, 40" should read --25, 45--.

COLUMN 11

Line 2, "closure" should read --closure 6--.
Line 24, "FIG." should read --FIG. 1--.
Line 38, "cusp" should read --cusp of--.

COLUMN 12

Line 5, "vided In" should read --vided. In--.
Line 6, "a" should read --an--.

UNITED STATES PATENT AND TRADEMARK OFFICE

CERTIFICATE OF CORRECTION

PATENT NO. : 5,221,143

DATED : June 22, 1993

INVENTOR(S) : HARRY R. PEPPIATT

It is certified that error appears in the above-indentified patent and that said Letters Patent is hereby corrected as shown below:

COLUMN 14

Line 19, "a" should read --an--.

COLUMN 15

Line 10, "a M-shaped" should read --an M-shaped--.
Line 15, "a M-shaped" should read --an M-shaped--.

COLUMN 16

Line 7, "non" should read --non- --.
Line 13, "portions" should read --portion--.

Signed and Sealed this

Seventeenth Day of May, 1994

Bruce Lehman

*Attest:*

BRUCE LEHMAN

*Attesting Officer*

*Commissioner of Patents and Trademarks*